US008191608B2

(12) United States Patent
Mizuno et al.

(10) Patent No.: US 8,191,608 B2
(45) Date of Patent: Jun. 5, 2012

(54) DEVICE FOR LOW-PRESSURE CASTING, A METHOD FOR FILLING INERT GAS IN THE DEVICE, AND METHOD FOR PRODUCING A CAST

(75) Inventors: Shinya Mizuno, Toyokawa (JP); Yutaka Murata, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 25 days.

(21) Appl. No.: 12/596,112

(22) PCT Filed: Apr. 8, 2008

(86) PCT No.: PCT/JP2008/056924

§ 371 (c)(1),
(2), (4) Date: Oct. 15, 2009

(87) PCT Pub. No.: WO2008/132991

PCT Pub. Date: Nov. 6, 2008

(65) Prior Publication Data

US 2010/0108285 A1 May 6, 2010

(30) Foreign Application Priority Data

Apr. 16, 2007 (JP) ..... 2007-106639
Jun. 14, 2007 (JP) ..... 2007-157055

(51) Int. Cl.
*B22D 18/04* (2006.01)
*B22D 18/08* (2006.01)
*B22D 46/00* (2006.01)

(52) U.S. Cl. .... 164/457; 164/66.1; 164/119; 164/150.1; 164/151; 164/259; 164/306

(58) Field of Classification Search ..... 164/457, 164/119, 306, 150.1, 151, 259, 66.1
See application file for complete search history.

(56) References Cited

U.S. PATENT DOCUMENTS 5,913,358 A * 6/1999 Chadwick ..... 164/457
5,948,352 A * 9/1999 Vender Jagt et al. ..... 266/239

FOREIGN PATENT DOCUMENTS

| | | |
|---|---|---|
| JP | 01-104457 | 4/1989 |
| JP | 11-285807 | 10/1999 |
| JP | 2000-042715 | 2/2000 |
| JP | 2000-271723 | 3/2000 |

* cited by examiner

*Primary Examiner* — Kevin P Kerns
(74) *Attorney, Agent, or Firm* — Finnegan, Henderson, Farabow, Garrett & Dunner, L.L.P.

(57) ABSTRACT

A device for low-pressure casting wherein the stalk or the guiding tube is filled with inert gas by causing the space formed over the molten metal in the pressurizing room to communicate with the stalk or the guiding tube. The device for low-pressure casting (100) wherein molten metal is supplied into a mold through a stalk (8) suspended from a gate for pouring of the mold (7) or through a guiding tube (21) connected to the gate for pouring at one end by pressurizing the molten metal by inert gas, the device including: a room for holding molten metal (1); a pressurizing room (2) to be in communication with the room for holding molten metal through a hole for communication (4), wherein a bottom end of the stalk (8) enters the pressurizing room or an opposite end of the guiding hole is connected to the pressurizing room, and wherein the molten metal is pressurized by inert gas; an on-off valve (5) for opening and shutting the hole for communication; a sensing device (15) for sensing that the space over the molten metal in the pressurizing room communicates with the stalk or the guiding tube; and a device (30) for supplying inert gas to an upper part of the pressurizing room.

9 Claims, 7 Drawing Sheets

DEVICE FOR LOW-PRESSURE CASTING, A METHOD FOR FILLING INERT GAS IN THE DEVICE, AND METHOD FOR PRODUCING A CAST

TECHNICAL FIELD

The present invention relates to a device for low-pressure casting, a method for filling inert gas in the device, and a method for producing a cast.

BACKGROUND ART

Conventionally a device for low-pressure casting has been proposed. The device does not have a complicated structure. It allows air in a mold, a tube for casting (a stalk), and a holding furnace to be effectively replaced with non-oxidizing gas. The device comprises a holding furnace that is sealed almost airtightly, a means for supplying non-oxidizing gas to the holding furnace, a stalk by which the holding furnace communicates with a mold, and a means for switching the opening of the stalk at the holding furnace side to the position for casting or to the position for replacing a mold. At the position for casting, the opening is immersed in molten metal. At the position for replacing, at least a part of the opening is over the surface of the molten metal in the holding furnace. Non-oxidizing gas is supplied to the holding furnace when the stalk is shifted to the position for replacing. Thus the air in the holding furnace, the stalk, and the mold is replaced with the non-oxidizing gas (see Japanese Patent Laid-open Publication No. 2000-42715).

DISCLOSURE OF INVENTION

However, in the conventional device for low-pressure casting with the above structure, the time for each cycle of casting gets longer and the productivities and efficiencies deteriorate, since the holding furnace must go up and down for each replacement of air with non-oxidizing gas in the holding furnace, the stalk, and the mold. Moreover, its structure is complicated. In addition, it is difficult to keep a seal between the cover of the holding furnace and the stalk. These are the problems.

To solve the problems, the objectives of the present invention are to provide a device for low-pressure casting, a method for filling non-oxidizing gas in a device, and a method for producing a cast by using the device for low-pressure casting. In the present invention a space formed over the molten metal in the pressurized room is in communication with the stalk or a guiding tube to facilitate filling the stalk or the guiding tube with non-oxidizing gas. The stalk is suspended from the gate for pouring of the mold and the guiding tube is connected to the gate for pouring.

To solve the problems, the device for low-pressure casting of the present invention is a casting device in which molten metal is pressurized by inert gas to be poured into a mold through a stalk that is suspended from the gate for pouring of the mold or a guiding tube connected to the gate for pouring. It comprises a room for holding molten metal, a pressurizing room, an on-off valve, a sensing means, and a means for supplying inert gas. The pressurizing room is in communication with the room for holding molten metal through a hole for communication. The lower end of the stalk is inserted into the pressurizing room, or the end of the guiding tube is connected to the pressurizing room. The end of the guiding tube is the one that is opposite to the end connected to the gate for pouring. In the pressurizing room the surface of the molten metal is pressurized by inert gas. The on-off valve opens and shuts the hole for communication. The sensing means senses the communication between the space over the molten metal in the pressurizing room and the stalk or guiding tube. The means for supplying inert gas supplies it to the upper part of the pressurizing room.

In the device for low-pressure casting with such a configuration, the on-off valve is opened to supply molten metal from the room for holding molten metal to the pressurizing room through the hole for communication. Then, the hole for communication is shut by the on-off valve to stop supplying molten metal. Then, the means for supplying inert gas supplies inert gas to the pressurizing room to pressurize the molten metal. Thus the molten metal from the pressurizing room is filled in the mold cavity of the mold through the stalk or the guiding tube. After the solidification of the molten metal that is filled in the mold cavity of the mold, the hole for communication is opened by the on-off valve and the molten metal in the pressurizing room returns to the room for holding the molten metal. The upper part of the pressurizing room communicates with the stalk or the guiding tube. Thus the inert gas in the pressurizing room flows into the stalk or the guiding tube. The sensing means checks whether the space over the molten metal in the pressurizing room communicates with the stalk or the guiding tube. As a result, thereafter the molten metal in the stalk or the guiding tube is prevented from being exposed to air.

As described above, in the present invention the molten metal is filled in the mold by pressurizing the surface of the molten metal with inert gas in the pressurizing room. After solidifying the molten metal filled in the mold, the molten metal in the pressurizing room is returned to the room for holding it by opening the hole for communication by the on-off valve. The sensing means is installed to sense the communication between the space over the molten metal in the pressurizing room and the stalk or the guiding tube. Thus the inert gas in the pressurizing room can definitely flow into the stalk or the guiding tube, since the space over the molten metal in the pressurizing room communicates with the stalk or the guiding tube. Therefore, to prevent oxidized metal from forming on the molten metal in the stalk or the guiding tube, the surface of the molten metal in the stalk or the guiding tube is not exposed to air. The present invention has such advantageous effects.

The basic Japanese patent applications, No. 2007-106639, filed Apr. 16, 2007, and No. 2007-157055, filed Jun. 14, 2007, are hereby entirely incorporated by reference into the present application. The present invention will become more fully understood from the detailed description given below. However, the detailed description and the specific embodiment are only illustrations of desired embodiments of the present invention, and are given only for an explanation. Various possible changes and modifications will be apparent to those of ordinary skill in the art on the basis of the detailed description. The applicant has no intention to dedicate to the public any disclosed embodiment. Among the disclosed changes and modifications, those which may not literally fall within the scope of the present claims constitute, therefore, a part of the present invention in the sense of the doctrine of equivalents. The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illuminate the invention, and so does not limit the scope of the invention, unless otherwise claimed.

BEST MODE FOR CARRYING OUT THE INVENTION

Figure 1:
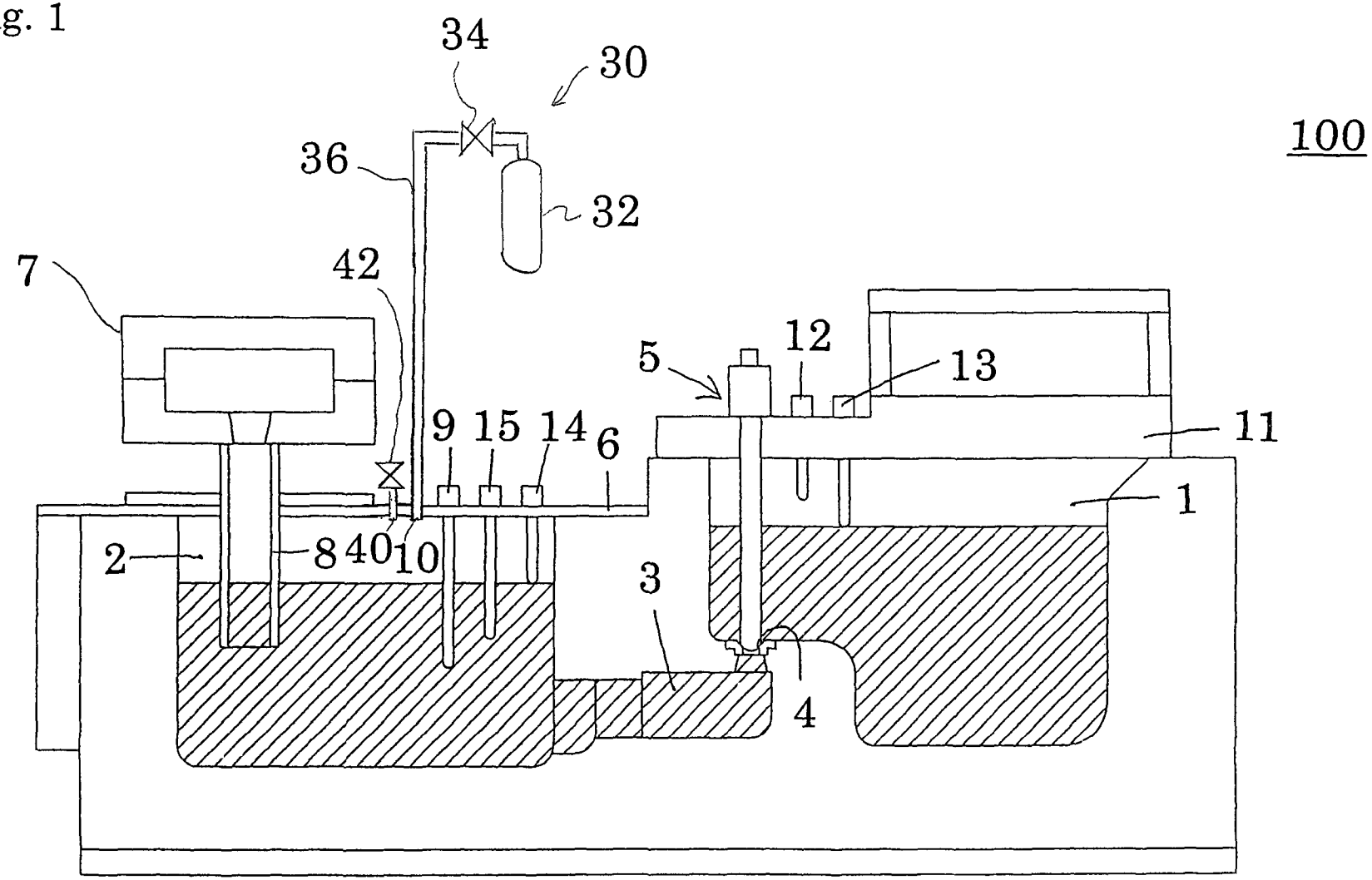
FIG. 1 is a vertical sectional view of the device for low-pressure casting of the first embodiment of the present invention.
Figure 2:
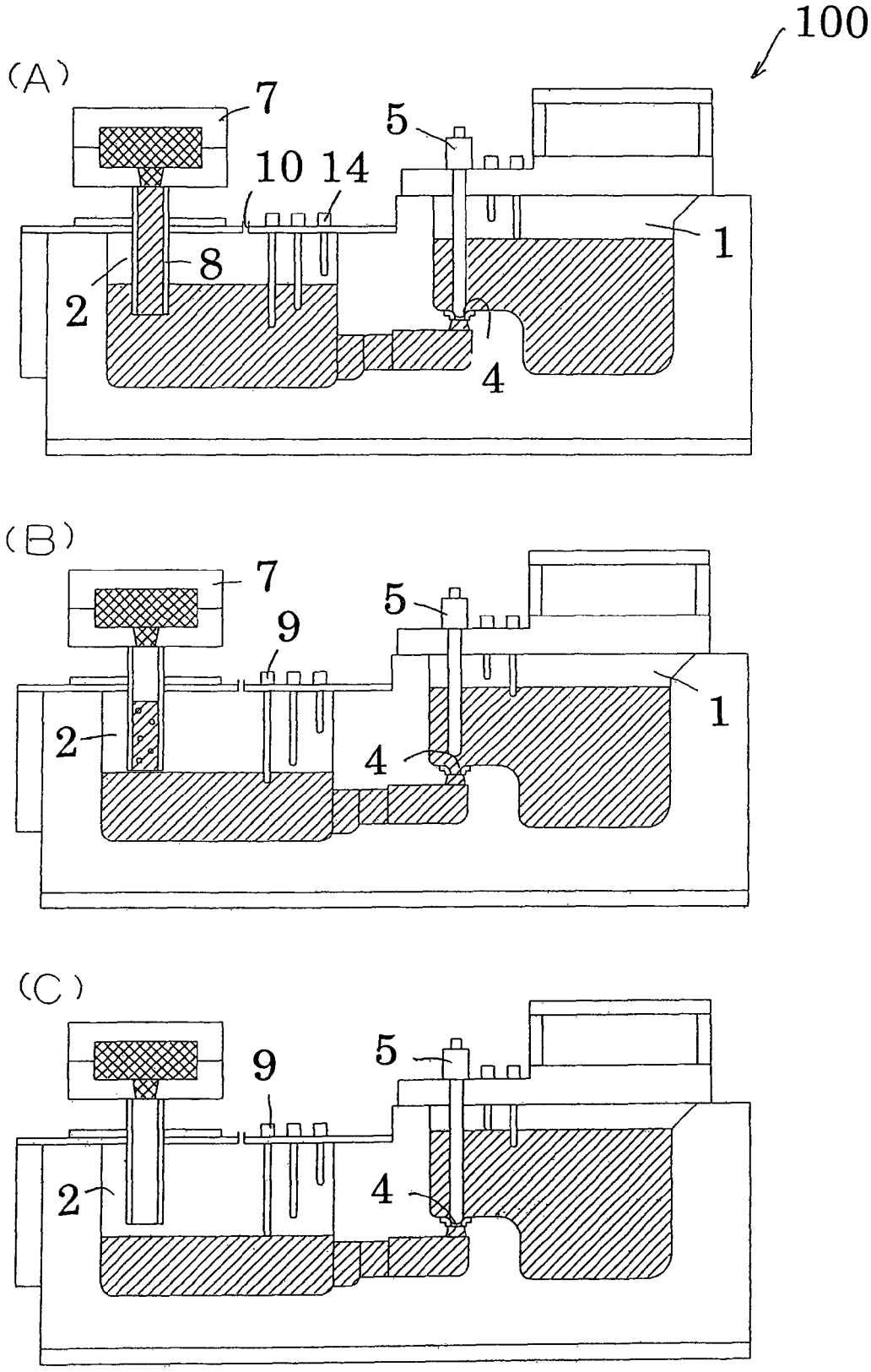
FIG. 2 illustrates the operation of the device for low-pressure casting of FIG. 1.
Figure 3:
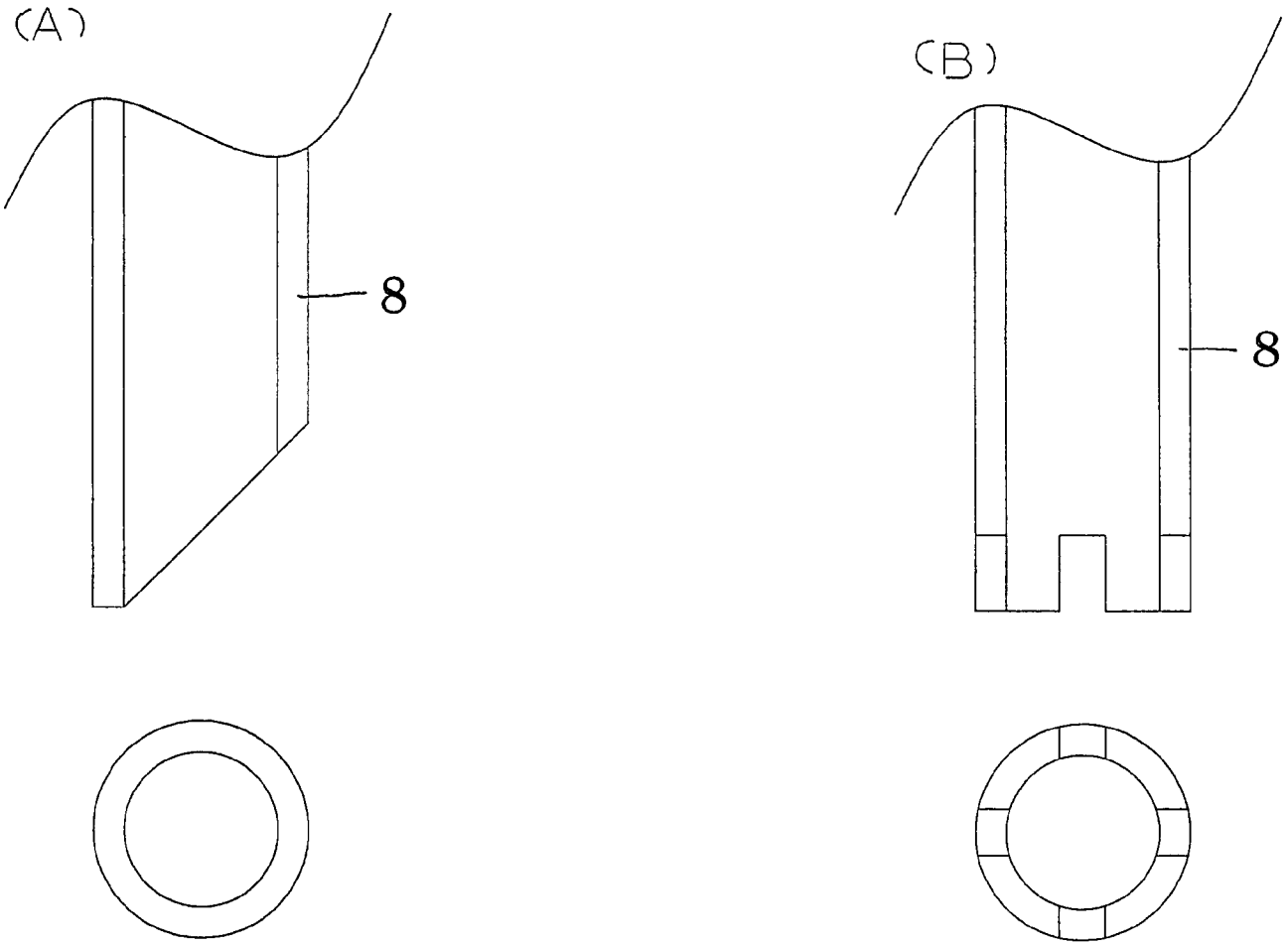
FIG. 3 is a vertical sectional view of another embodiment of the lower end of the stalk.

The first four embodiments of the device for low-pressure casting of the present invention will now be described in detail based on FIGS. 1-7. As the first embodiment, the device for low-pressure casting 100, which has a level sensor 9 as the sensing means, is described. As shown in FIG. 1, it comprises a room for holding molten metal 1, a pressurizing room 2 for pressurizing molten metal by inert gas, an on-off valve 5 for opening and shutting a hole for communication 4 to communicate between the room for holding molten metal 1 and the pressurizing room 2 through an auxiliary room 3, a cover 6 for shutting the upper-end opening of the pressurizing room 2 and sealing it, a stalk 8 suspended from a gate for pouring of a mold 7, the level sensor 9 for sensing the level of the surface of the molten metal in the pressurizing room 2, and a means 30 for supplying inert gas to the upper part of the pressurizing room 2. The pressurizing room 2 is configured to communicate with the room for holding molten metal 1. The stalk 8 passes vertically through the cover 6 and enters the pressurizing room 2. The level sensor 9 passes through the cover 6 and is suspended from it. The means for supplying inert gas 30 is connected to a hole for supplying inert gas 10 formed in the cover 6.

In the device for low-pressure casting 100, a part of the hole for communication 4 is used as a valve seat, and the valve body of the on-off valve 5 is used to open and shut the hole for communication 4. However, a valve having a valve seat and a valve body can be installed in the hole for communication 4 to open and shut it.

In the means for supplying inert gas 30, a tank for storing inert gas 32 is connected to the hole for supplying inert gas 10 through an on-off valve 34 and piping 36. An exhaust hole 40 is provided in the upper part of the pressurizing room 2 to exhaust inert gas to reduce the pressure of the space over the molten metal to the atmospheric pressure. An electro-magnetic valve 42 is connected to the exhaust hole 40. On the cover 11 for sealing the upper-end opening of the room for holding molten metal 1, level sensors 12, 13, for sensing the upper and lower limits of the level of the molten metal in the room for holding molten metal 1, are equipped, respectively. On the cover 6, level sensors 14, 15 for sensing the upper limit of the level and a predetermined middle level, of the molten metal in the pressurizing room 2 are installed, respectively. Here, the level sensor 15, for sensing the middle level, is configured to sense the surface of the molten metal that is positioned some mm to some tens of mm from the bottom of the stalk 8.

In the device for low-pressure casting 100 with the above configuration, the means for supplying inert gas 30 supplies it to the space over the molten metal in the pressurizing room 2 through the hole for supplying inert gas 10. Moreover, the inert gas is exhausted through the exhaust hole 40 to prevent the space over the molten metal in the pressurizing room 2 from being at too high a pressure. In this condition the on-off valve 5 is first operated to open the hole for communication 4. The molten metal in the room for holding molten metal is supplied to the pressurizing room 2. When the level sensor 14 senses the upper limit of the level of the molten metal in the pressurizing room 2 has been reached, the on-off valve 5 is operated to shut the hole for communication 4. Then inert gas that is higher in pressure is supplied through the hole for supplying inert gas 10 to pressurize the molten metal in the pressurizing room 2. The molten metal from the pressurizing room 2 is filled in the mold cavity of the mold 7 through the stalk 8 (see FIG. 2A). After the molten metal in the mold cavity of the mold 7 solidifies, the on-off valve 5 is operated to open the hole for communication 4 to allow the molten metal in the pressurizing room 2 to return to the room for holding molten metal 1 (see FIG. 2B).

The pressure of the inert gas in the pressurizing room 2 may be controlled by any other method in addition to the above process. For example, it can be controlled by an electro-magnetic on-off valve 42 connected to the exhaust hole 40. The pressure at which the inert gas is exhausted can be changed by controlling the operation of the electro-magnetic on-off valve 42. Alternatively, the pressure for supplying inert gas may be changed by controlling the operation of the on-off valve 34 in the means for supplying inert gas 30.

When the level sensor 15 senses the predetermined level of the molten metal in the pressurizing room 2, the pressure for supplying inert gas through the hole for supplying inert gas 10 is controlled to be reduced. Thus, when the level of the molten metal is further lowered, and the space over the molten metal communicates with the stalk 8, the inert gas gently flows into the stalk 8 without including any molten metal. After the level sensor 9 senses that the level of the molten metal where the space formed over the molten metal in the pressurizing room 2 communicates with the stalk 8 has been reached, the on-off valve 5 is operated to shut the hole for communication 4 (see FIG. 2C). The word "communicate" means the condition where the path of the gas (inert gas) is formed without being obstructed by the molten metal.

Next, the pressure at the space over the molten metal in the pressurizing room 2 is reduced to close to the atmospheric pressure by causing the inert gas to be exhausted through the exhaust hole 40. Thereafter, the cast, which is formed by solidifying the molten metal, is taken out of the mold 7.

In the device for low-pressure casting 100, the level sensor 9 senses the communication between the space over the molten metal and the stalk 8. Thus the hole for communication 4 can be shut by the on-off valve 5 to stop returning the molten metal in the pressurizing room 2 to the room for holding molten metal 1 after checking the inert gas flowing into the stalk 8. That is, the inert gas in the pressurizing room 2 definitely flows into the stalk 8, since the space over the molten metal in the pressurizing room 2 communicates with the stalk 8. Thus, to definitely prevent oxidized metal from forming on the molten metal in the stalk 8, the surface of the molten metal in the stalk 8 is not exposed to air. In addition, excess molten metal is prevented from being returned to the room for holding the molten metal 1. Thus the time for a cycle of casting can be shortened and the productivity and efficiencies can be enhanced. Moreover, since the relative distance between the room for holding molten metal 1 and the stalk 8 or the pressurizing room 2 and the stalk 8 is not changed, gas is prevented from leaking.

The cast, which is formed by solidifying the molten metal, is taken out of the mold cavity after splitting the cope from the drag of the mold 7. Subsequently the cope and drag are matched to form the mold cavity. In the device for low-pressure casting 100, the mold cavity may be filled with inert gas, which is supplied through the stalk 8.

As shown in FIGS. 3A and 3B, the bottom end of the stalk 8 may be formed with an oblique opening or intermittent cutouts. With such configurations, while the bottom end of the stalk 8 is immersed in molten metal in the pressurizing room 2, which metal is supplied from the room for holding molten metal 1, a part of the bottom end opens above the surface of the molten metal. Thus the molten metal flows more smoothly into the stalk 8 by the pressure of the inert gas.

Figure 4:
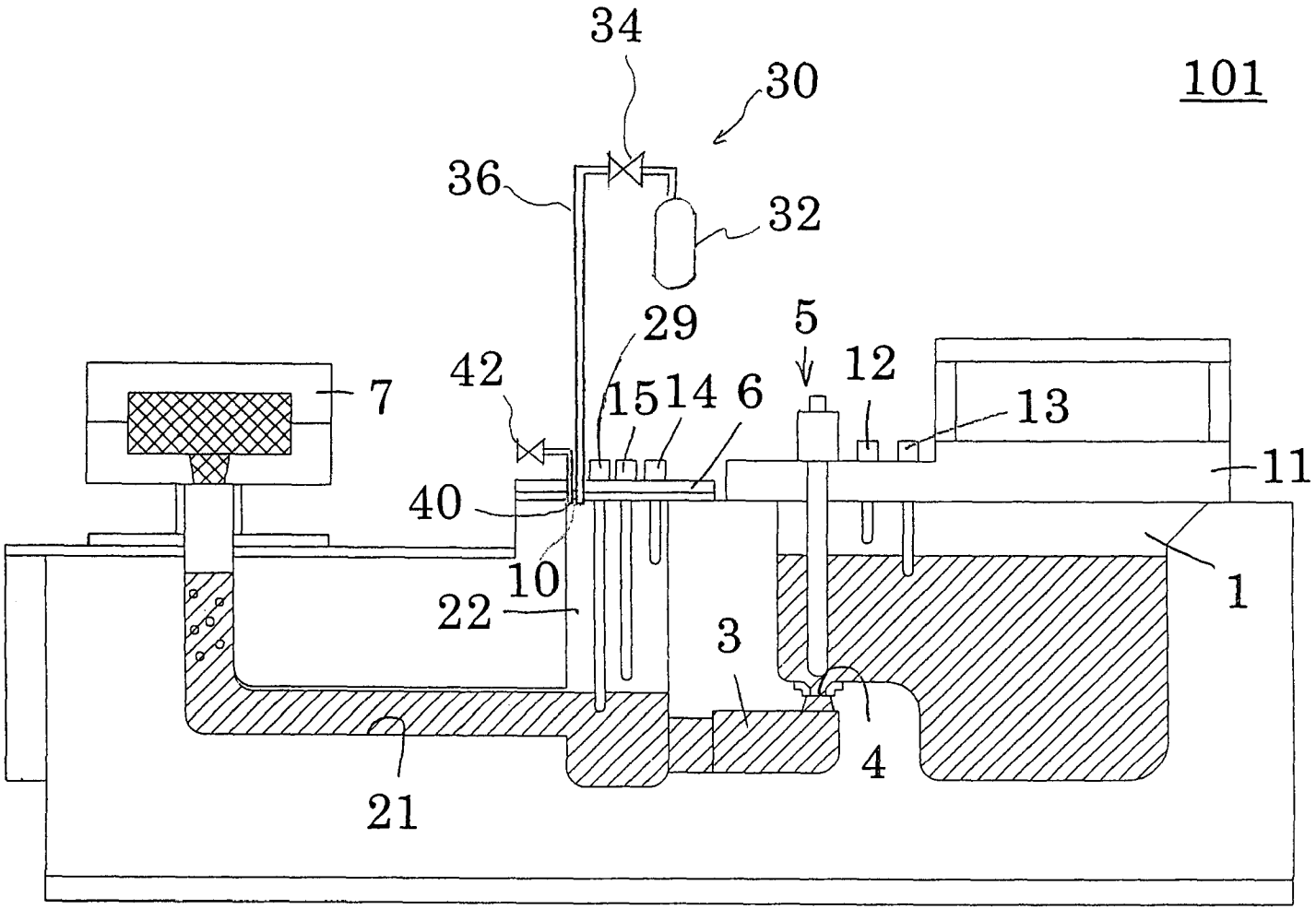
FIG. 4 is a vertical sectional view of the device for low-pressure casting of the second embodiment of the present invention.

In the above embodiment, the molten metal from the pressurizing room 2 is filled in the mold cavity of the mold 7 through the stalk 8. However, that does not limit the invention. For example, as shown in the device for low-pressure casting 101, which is illustrated in FIG. 4, a guiding tube 21, which leads the molten metal from the pressurizing room 2 to the gate for pouring of the mold 7, may be connected to the pressurizing room 22. In this case, a level sensor 29, which has the same function as the level sensor 9, senses the level of the molten metal in the pressurizing room 22. At that level the space formed over the molten metal in the pressurizing room 22 communicates with the guiding tube 21.

In addition, in the above embodiment a contact level sensor is used for the level sensor for sensing the level of the molten metal. However, this does not limit the invention. For example, a non-contact level sensor, such as an ultrasonic level sensor, may be used.

In the above embodiment, the means for supplying inert gas 30 comprises the tank 32, the on-off valve 34, and the piping 36. However, that does not limit the invention. Any other construction, such as a device for separating nitrogen from the atmosphere and pressurizing it by a compressor, may also be used.

Figure 5:
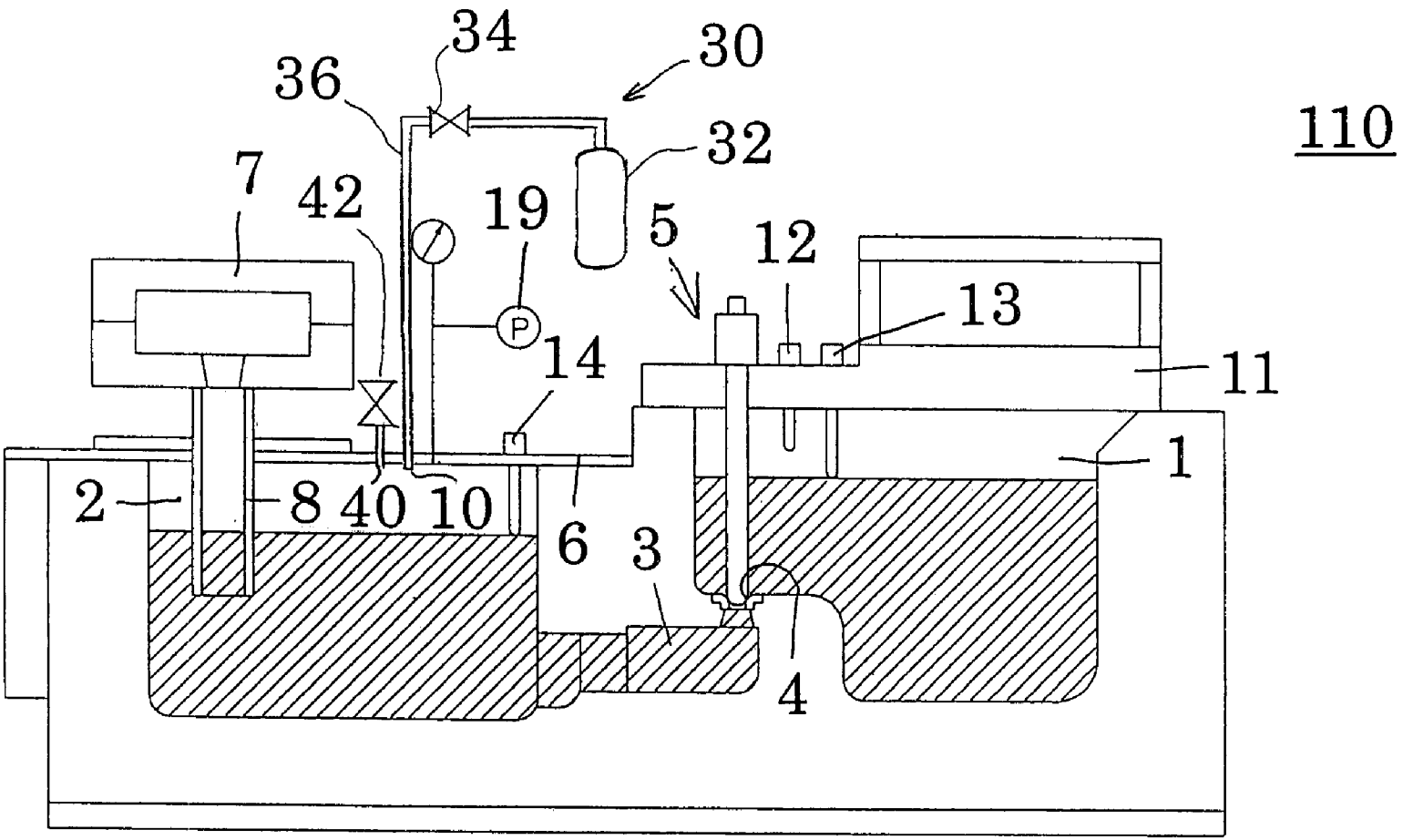
FIG. 5 is a vertical sectional view of the device for low-pressure casting of the third embodiment of the present invention.
Figure 6:
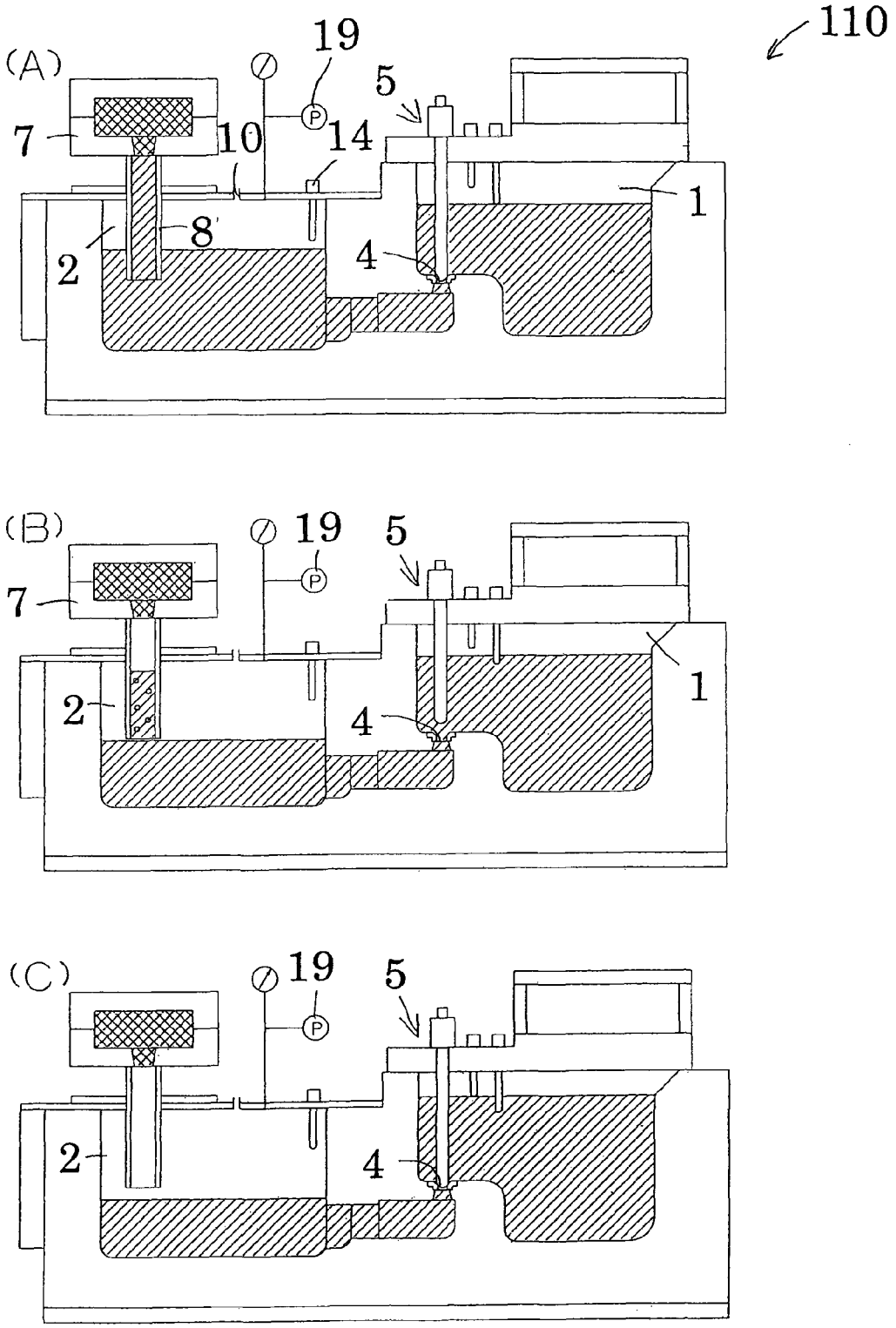
FIG. 6 illustrates the operation of the device for low-pressure casting of FIG. 5.

Next, in reference to FIG. 5, the device for low-pressure casting 110 as the third embodiment is described. As shown in FIG. 5, the device for low-pressure casting 110 comprises a pressure sensor 19 in place of the level sensor 9 of the device for low-pressure casting in FIG. 1. The pressure sensor 19 is supported by the cover 6 and senses the pressure in the pressurizing room 2.

As a level sensor in the pressurizing room 2, the level sensor 14 for sensing the upper limit of the level of the molten metal in the pressurizing room 2 is installed. Both the electromagnetic on-off valve 42 and the on-off valve 34, either of which can control the pressure of the inert gas in the pressurizing room 2, as described in regards to the device for low-pressure casting 100, function as a means for controlling the pressure. The means for controlling the pressure controls the pressure in the pressurizing room 2 based on the pressure measured by the pressure sensor 19 or any other pressure sensor. Typically, a controlling device (not shown) that receives a signal on the pressure and operates a means for controlling the pressure is installed.

In the device for low-pressure casting 110 with the above configuration, the means for supplying inert gas 30 supplies it to the space over the molten metal in the pressurizing room 2 through the hole for supplying inert gas 10. Moreover, the inert gas is exhausted through the exhaust hole 40 to prevent the space over the molten metal in the pressurizing room 2 from being at too high a pressure. In this condition the on-off valve 5 is first operated to open the hole for communication 4. The molten metal in the room for holding molten metal 1 is supplied to the pressurizing room 2. When the level sensor 14 senses the upper limit of the level of the molten metal in the pressurizing room 2, the on-off valve 5 is operated to shut the hole for communication 4. Then inert gas that has a higher pressure is supplied through the hole for supplying inert gas 10 to pressurize the molten metal in the pressurizing room 2. The molten metal from the pressurizing room 2 is filled in the mold cavity of the mold 7 through the stalk 8 (see FIG. 6A). After the molten metal in the mold cavity of the mold 7 solidifies, the on-off valve 5 is operated to open the hole for communication 4 and the pressure of the inert gas from the means for supplying inert gas 30 is controlled. Thus the molten metal in the pressurizing room 2 returns to the room for holding molten metal 1 (see FIG. 6B). The pressure sensor 19 senses that the level of the molten metal in the pressurizing room 2 is lower and senses the space over the molten metal is in communication with the stalk 8. After the level of the molten metal is lowered some more, to reach the predetermined amount, the on-off valve 5 is operated to shut the hole for communication 4 (see FIG. 6C). That is, the pressure sensor 19 senses, as the predetermined pressure, the pressure at the condition where the space over the molten metal in the pressurizing room 2 communicates with the stalk 8, when the level of the molten metal is lowered by returning the molten metal in the pressurizing room 2 to the room for holding molten metal 1. The pressure sensor 19 can sense any other pressure, such as the pressure under the condition just before the space over the molten metal in the pressurizing room 2 communicates with the stalk 8. Then, the pressure of the inert gas supplied through the holes for supplying inert gas 10 may be controlled to be reduced. By doing so, when the level of the molten metal is lowered some more, to allow the space over the molten metal to communicate with the stalk, the inert gas gently flows into the stalk 8 without including the molten metal.

While the level of the molten metal is being lowered from the level where the space over the molten metal communicates with the stalk 8, the inert gas in the pressurizing room 2 flows into the stalk 8. Then, the pressure at the space over the molten metal in the pressurizing room 2 becomes almost the same as the atmospheric pressure by exhausting the inert gas through the exhaust hole. Then, the cast, which is formed by solidifying the molten metal, is taken out of the mold 7.

Even in the device for low-pressure casting 110, the cast, which is formed by solidifying the molten metal, is taken out of the mold cavity after splitting the cope from the drag of the mold 7. Then the cope and drag are matched to form the mold cavity. The mold cavity may be filled with inert gas from the pressurizing room 2, which is supplied through the stalk 8.

Figure 7:
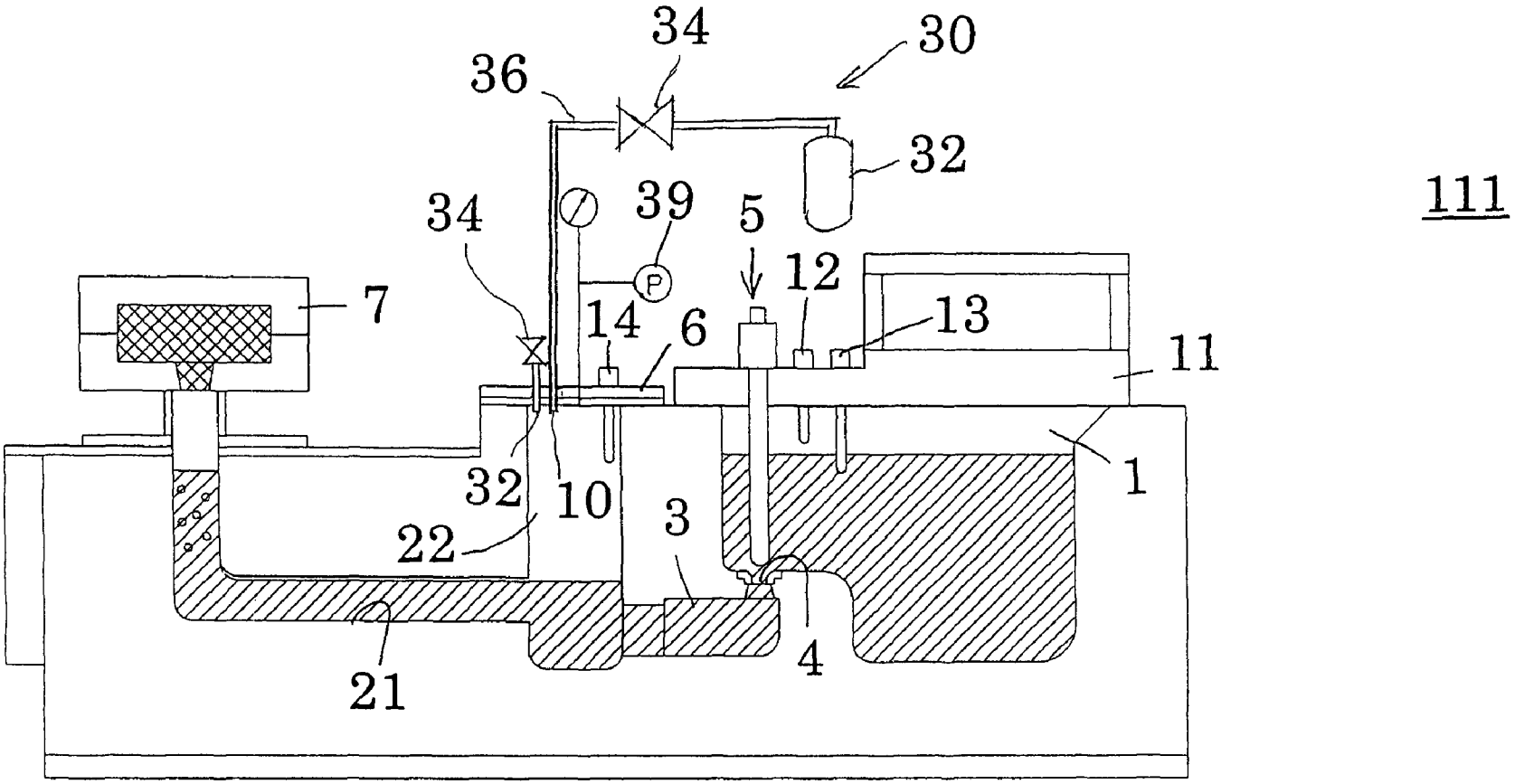
FIG. 7 is a vertical sectional view of the device for low-pressure casting of the fourth embodiment of the present invention.

In the above embodiment, the molten metal from the pressurizing room 2 is filled in the mold cavity of the mold 7 through the stalk 8. That does not limit the invention. For example, as shown in the device for low-pressure casting 111, which is illustrated in FIG. 7, the guiding tube 21, which guides the molten metal in the pressurizing room 22 to the gate for pouring of the mold 7, may be connected to the pressurizing room 22. In this case, a pressure sensor 39, which has the same function as the pressure sensor 19, senses, as the predetermined pressure, the pressure in the pressurizing room 22, where the space formed over the molten metal in the pressurizing room 22 communicates with the guiding tube 21.

In the above embodiments, the sensing means may be either the level sensor 9 or 29 or the pressure sensor 19 or 39. However, any other sensing means that senses that the space over the molten metal in a pressurizing room communicates with a stalk may be used. For example, the sensing means can sense that condition based on the weight of the pressurizing rooms 2, 22 or based on the electric resistance between two distant points.

The invention claimed is:

1. A device for low-pressure casting where molten metal is supplied in a mold, the device comprising:

a mold, a stalk suspended from a gate for filling of the mold or a guiding tube connected at one end to the gate for filling the mold with molten metal by pressurizing molten metal with inert gas:

a room for holding molten metal;

a pressurizing room that communicates with the room for holding molten metal through a hole for communication, wherein a bottom end of the stalk is located in the pressurizing room, or an opposite end of the guiding tube is connected to the pressurizing room;

an on-off valve for opening and closing the hole for communication, the on-off valve when open permitting molten metal to be supplied from the room for holding molten metal to the pressurizing room through the hole for communication and permitting molten metal in the pressurizing room to be returned to the room for holding molten metal through the hole for communication;

a sensing means for sensing that a space over the molten metal in the pressurizing room communicates with the stalk or the guiding tube; and a means for supplying inert gas to an upper part of the pressurizing room to pressurize a surface of the molten metal in the pressurizing room and cause the molten metal to flow into the stalk or guiding tube and fill the mold.

2. The device for low-pressure casting of claim 1, wherein the sensing means is a level sensor for sensing a level of the molten metal in the pressurizing room at which the space over the molten metal in the pressurizing room communicates with the stalk or the guiding tube.

3. The device for low-pressure casting of claim 1, wherein the sensing means is a pressure sensor for sensing a predetermined pressure in the pressurizing room at which the space over the molten metal in the pressurizing room communicates with the stalk or the guiding tube.

4. The device for low-pressure casting of any one of claims 1 to 3, wherein the stalk is suspended from the gate for filling, and wherein a bottom end of the stalk is formed so as to be open over the surface of the molten metal in the pressurizing room while the bottom end is immersed in the molten metal in the pressurizing room, the molten metal being supplied from the room for holding molten metal.

5. A method for flowing inert gas into the stalk or the guiding tube of the device for low-pressure casting of claim 2, the method comprising the steps of:

supplying molten metal to the mold through the stalk or the guiding tube by pressurizing the surface of the molten metal with inert gas in the pressurizing room;

opening the hole for communication after the supplied molten metal in the mold solidifies;

returning the molten metal in the pressurizing room to the room for holding molten metal to enable the level sensor to sense the level of the molten metal in the pressurizing room; and causing a space formed over the molten metal in the pressurizing room to communicate with the stalk or the guiding tube, whereby inert gas in the pressurizing room will flow into the stalk or the guiding tube.

6. A method for flowing inert gas into a mold cavity of the mold in the device for low-pressure casting of claim 2, the method comprising the steps of:

supplying molten metal to the mold through the stalk or the guiding tube by pressurizing the surface of the molten metal with inert gas in the pressurizing room;

opening the hole for communication after the supplied molten metal in the mold solidifies;

returning the molten metal in the pressurizing room to the room for holding molten metal to enable the level sensor to sense the level of the molten metal in the pressurizing room;

causing a space formed over the molten metal in the pressurizing room to communicate with the stalk or the guiding tube;

forming a mold cavity in the mold; and after forming the mold cavity, supplying inert gas to the pressurizing room to flow inert gas into the mold cavity.

7. A method for flowing inert gas into the stalk or the guiding tube in the device for low-pressure casting of claim 3, the method comprising the steps of:

supplying molten metal to the mold through the stalk or the guiding tube by pressurizing the surface of the molten metal with inert gas in the pressurizing room;

opening the hole for communication after the supplied molten metal in the mold solidifies;

lowering a level of the molten metal by returning the molten metal in the pressurizing room to the room for holding molten metal to enable the pressure sensor to sense a predetermined pressure in the pressurizing room; and causing a space formed over the molten metal in the pressurizing room to communicate with the stalk or the guiding tube, whereby inert gas in the pressurizing room will flow into the stalk or the guiding tube.

8. A method for flowing inert gas into a mold cavity of the mold in the device for low-pressure casting of claim 3, the method comprising the steps of:

supplying molten metal to the mold through the stalk or the guiding tube by pressurizing the surface of the molten metal with inert gas in the pressurizing room;

opening the hole for communication after the supplied molten metal in the mold solidifies;

lowering a level of the molten metal by returning the molten metal in the pressurizing room to the room for holding molten metal to enable the pressure sensor to sense a predetermined pressure in the pressurizing room;

causing a space formed over the molten metal in the pressurizing room to communicate with the stalk or the guiding tube;

forming a mold cavity in the mold; and after forming the mold cavity, supplying inert gas to the pressurizing room to flow inert gas into the mold cavity.

9. A method for producing a casting with the device for low-pressure casting of any one of claims 1 to 3, the method comprising the steps of:

supplying inert gas from the means for supplying inert gas to the pressurizing room;

opening the hole for communication with the on-off valve to supply molten metal from the room for holding molten metal to the pressurizing room;

after the step of opening, closing the hole for communication with the on-off valv and supplying inert gas from the means for supplying inert gas to the pressurizing roan to pressurize the surface of the molten metal to fill the molten metal from the pressurizing room into the mold;

cooling the molten metal filled in the mold to form a casting;

after the molten metal filled in the mold is solidified, opening the on-off valve to return molten metal from the pressurizing room to the room for holding molten metal; and after returning the molten metal to the room for holding molten metal providing the space formed over the molten metal in the pressurizing room that communicates with the stalk or the guiding tube, shutting the hole for communication with the on-off valve.

* * * * *